United States Patent [19]

Needle

[11] Patent Number: 5,012,986

[45] Date of Patent: May 7, 1991

[54] SPARE TOILET TISSUE HOLDER

[76] Inventor: Lloyd H. Needle, 9100 Potomac Station La., Potomac, Md. 20854

[21] Appl. No.: 196,814

[22] Filed: May 17, 1988

Related U.S. Application Data

[63] Continuation of Ser. No. 59,819, Jun. 9, 1987, abandoned.

[51] Int. Cl.[5] ..... D01H 16/04

[52] U.S. Cl. ..... 242/55.300

[58] Field of Search ..... 242/55.3, 55.53, 55.42, 242/129.5, 130, 134, 136, 141; 211/59.2, 87, 106, 113, 118, 16; D6/518, 520, 523; 206/389, 391

[56] References Cited

U.S. PATENT DOCUMENTS

| | | | |
|---|---|---|---|
| D. 179,846 | 3/1957 | Gralewicz | D6/523 |
| D. 204,595 | 5/1966 | Turbo | D6/523 |
| D. 252,842 | 9/1979 | McKee | D6/523 |
| D. 259,682 | 6/1981 | Standing | D6/523 |
| D. 267,760 | 2/1983 | Vrignaud | D6/523 |
| D. 277,347 | 1/1985 | Thompson | D6/523 |
| 416,842 | 12/1889 | Johnson | 242/55.2 |
| 448,799 | 3/1891 | Jackson | 242/136 X |
| 1,981,673 | 11/1934 | Smith | 242/55.2 |
| 2,523,951 | 9/1950 | Graumlich | D6/523 X |
| 2,528,055 | 10/1950 | Hartley et al. | 242/55.2 |
| 2,561,584 | 7/1951 | McDonald | 242/55.53 |
| 2,697,562 | 12/1954 | Langer | 242/55.3 |
| 2,790,608 | 4/1957 | Sieven | 242/55.3 |
| 3,049,310 | 8/1962 | Wolfe | 242/55.3 |
| 3,127,017 | 3/1964 | Dower | 242/55.3 X |
| 3,140,060 | 7/1964 | Layton et al. | 242/55.53 X |
| 3,266,742 | 8/1966 | Pena | 242/55.3 |
| 3,291,354 | 12/1966 | Ziebarth | 242/55.53 |
| 3,584,802 | 6/1971 | Sieber | 242/55.3 |
| 3,650,487 | 3/1972 | Bahnsen | 242/55.3 |
| 3,792,822 | 2/1974 | Underhill | 242/55.3 |
| 3,917,191 | 11/1975 | Graham et al. | 242/55.3 |
| 4,385,733 | 5/1983 | O'Keefe | 242/55.3 |
| 4,427,159 | 1/1984 | Miller et al. | 242/55.3 |

FOREIGN PATENT DOCUMENTS

| | | |
|---|---|---|
| 617494 | 8/1935 | Fed. Rep. of Germany . |
| 1073205 | 6/1967 | United Kingdom . |

*Primary Examiner*—Joseph J. Hail, III

*Attorney, Agent, or Firm*—Stevens, Davis, Miller & Mosher

[57] ABSTRACT

A holder for a spare roll of toilet tissue used in a bathroom, the holder comprising a C-shaped bar, rotatable sleeves inserted onto sections of the C-shaped bar, and ends of the sections extending at right angles thereto to prevent lateral movement of the holder and the spare roll.

3 Claims, 1 Drawing Sheet

FIG. 1
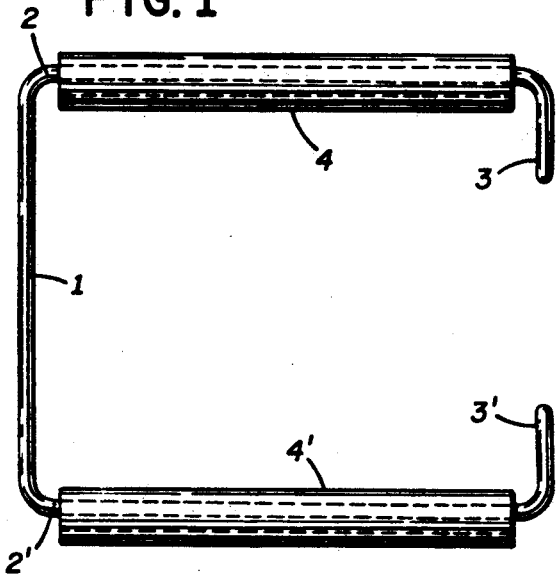
FIG. 4
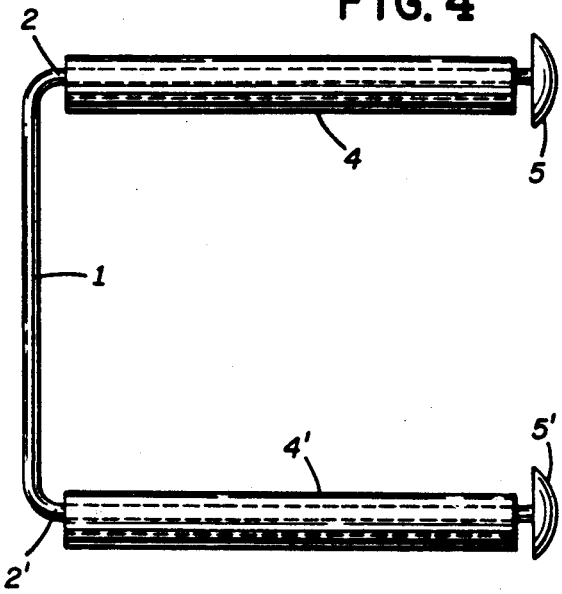
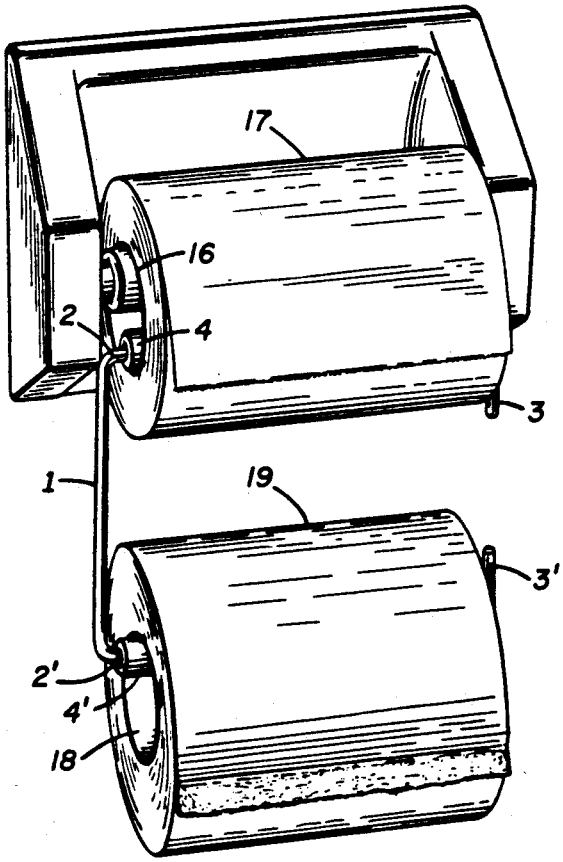
FIG. 2
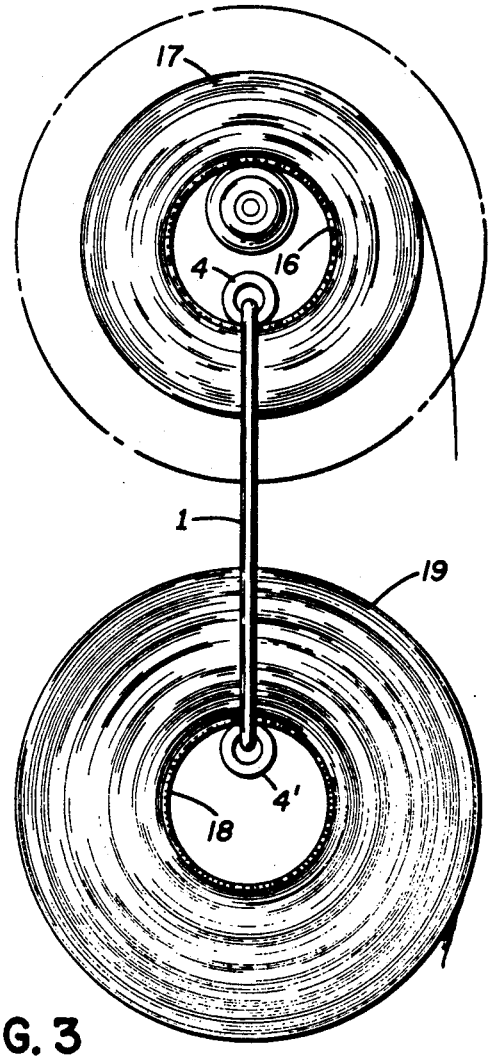
FIG. 3

SPARE TOILET TISSUE HOLDER

This application is a Continuation of application Ser. No. 059,819, filed Jun. 9, 1987now abandoned.

This invention relates to bathroom equipment and more specifically to holders for a spare roll of toilet tissure.

The advantages of having a spare roll of toilet tissue readily available near the toilet are well known. Specifically, it sometimes is not apparent that a roll of toilet tissue is about to run out until after a person is already seated. At those times, it would be advantageous to have a spare roll within reach.

In response to this need, spare roll holders have been developed. U.S. Pat. No. 2,790,608 to Siever and U.S. Pat. No. 4,427,159 to Miller et al disclose support brackets which hook onto the toilet roll spindle mounted in the bathroon wall. By having these brackets, widening of the distance between the brackets is required to install the spare roll. In the patent to Siever, the bracket has to be spread apart while the Miller patent discloses a holder requiring the spreading apart of the bracket to enable insertion of the spare roll spindle. As will be apparent from the following detailed description, this manipulation can be eliminated.

Therefore, it is an object of the present invention to provide a spare toilet roll holder which will avoid the disadvantages of the known spare toilet roll holders. A further object of this invention is to provide an easy to use and easy to make holder.

Briefly, the present invention comprises a C-shaped bar defining a vertical spine, two horizontal sections extending from the ends of said spine and means on one end of each section radially displaced therefrom to maintain a toilet tissue roll on the holder. In addition a rotatable sleeve is mounted on each of the horizontal sections of the holder. Either one of the horizontal sections of the C-bar can be easily inserted into and extended through the spindle of a mounted toilet tissue roll, while the remaining horizontal section can be inserted into the spindle of the spare toilet tissue roll. The sleeves are provided to facilitate the rolling of the toilet rolls. The ends of the horizontal sections are bent 90° to a common axis position or have enlarged ends to insure that the device does not slide off the mounted roll or that the spare roll does not slide off the device.

BRIEF DESCRIPTION OF THE DRAWINGS

FIG. 1 is a side elevation view of the invention;

FIG. 2 is a frontal view of the invention in use;

FIG. 3 is a side view of the invention in use; and

FIG. 4 is a side elevation view of another embodiment of the invention.

DETAILED DESCRIPTION OF THE INVENTION

Referring to FIG. 1, the invention comprises a C-shaped bar defining a vertical spine 1, two horizontal section 2,2' each connected at right angles to said vertical spine and free ends 3,3' each connected to one of said horizontal sections 2,2' to prevent lateral sliding and unintentional removal of the device from the mounted roll or removal of the spare roll from the device. Each horizontal section 2,2' of the C-shaped bar is identical to the other and is provided with sleeve 4 or 4'. Horizontal section 2 or 2' is bent perpendicularly to spine 1.

Other equivalent means to prevent this lateral sliding also can be envisioned. Specifically, the horizontal sections 2,2' can be constructed without perpendicularly bent ends 3,3' but have stopper caps 5,5' or their equivalents snugly inserted onto the ends of the horizontal sections 2,2'. As shown in FIG. 4, caps 5,5' have a diameter that is larger than the diameter of the C-bar so that the caps prevent the lateral sliding of the holder and the spare roll of toilet tissue.

The holder is installed by inserting either one of the identical ends 3,3' through the hollow spindle 16 of a mounted roll of toilet tissue 17. When this end has been inserted completely through spindle 16, the holder is in position to rest sleeve 4 on the interior of the mounted roll's spindle 16, as shown in FIG. 3 while at the same time permitting easy removal of the tissue from the mounted roll. Sleeve 4 facilitates the rolling of the mounted roll of toilet tissure 17 against the gravitational friction caused by the weight of the holder and the spare roll. In order to install the section 2 the length of end 3 or the diameter of cap 5 has to be less than the interior diameter of spindle 16. As shown in FIG. 2, this end 3 prevents the C-bar from laterally sliding out of the hollow spindle 16 of mounted toilet tissue roll 17.

A spare roll of toilet tissue 19 is installed on the holder by similarly inserting the opposite parallel section 2', through the spare roll's hollow spindle 18. However, the hollow spindle 18 of the spare roll 19 comes to rest on sleeve 4', as shown in FIGS. 2 and 3. The sleeve 4' serves to facilitate the rolling of the spare roll 19 as tissue is pulled from it. As shown in FIGS. 2 and 4, the bent end 3' cap 5' and section 2' prevent spare roll 19 from laterally sliding off the inserted section 2'.

I claim:

1. A toilet roll spindle suspendable holder for a spare roll of toilet tissue, comprising:

a C-shaped bar defining a spine, two sections connected perpendicularly to the spine at each end thereof and toilet tissue holding means on an end of each section radially projecting at least towards each other, said radial projection being less than the diameter of a hollow spindle upon which a roll of toilet tissue is carried; and a rotatable sleeve mounted and maintained on each section, said sections being longer than the axial length of a roll of toilet tissue, one section of said C-shaped bar and rotatable sleeve being insertable through a hollow spindle of a rigidly mounted roll of toilet tissue, and the other section and rotatable sleevve being insertable through a spindle of a roll of toilet tissue to be suspended from said rigidly mounted roll of toilet tissue.

2. The holder of claim 1 wherein said toilet tissue holding means are constituted by an end of each section being bent inwardly towards each other to a 90° angle with respect to the section.

3. The holder of claim 1 wherein said toilet tissue holding means comprises a stopper cap fitting over the end of each section.

* * * * *